US007059492B2

(12) United States Patent
Giraud et al.

(10) Patent No.: US 7,059,492 B2
(45) **Date of Patent: *Jun. 13, 2006**

(54) MOISTURE-PROOF RESEALABLE, NON-CYLINDRICAL CONTAINER FOR CONSUMER PACKAGES

(75) Inventors: Jean Pierre Giraud, Paris (FR); Michael Bucholtz, Ballston Spa, NY (US)

(73) Assignee: Capitol Plastic Products, LLC, Amsterdam, NY (US)

( * ) Notice: Subject to any disclaimer, the term of this patent is extended or adjusted under 35 U.S.C. 154(b) by 6 days.

This patent is subject to a terminal disclaimer.

(21) Appl. No.: 10/603,296

(22) Filed: Jun. 25, 2003

(65) Prior Publication Data

US 2004/0065669 A1 Apr. 8, 2004

(51) Int. Cl.
*B65D 43/16* (2006.01)

(52) U.S. Cl. ..... 220/834; 220/375; 220/780; 220/839

(58) Field of Classification Search ..... 206/204, 206/242, 265, 268, 269, 315.9; 215/43, 45, 215/237, 306, 321; 220/326, 796, 836, 839
See application file for complete search history.

(56) References Cited

U.S. PATENT DOCUMENTS

| | | | | |
|---|---|---|---|---|
| 3,346,099 | A * | 10/1967 | Thomas et al. | 220/833 |
| 5,114,003 | A * | 5/1992 | Jackisch et al. | 206/204 |
| 5,133,470 | A * | 7/1992 | Abrams et al. | 215/237 |
| 5,139,165 | A * | 8/1992 | Hara | 220/839 |
| 5,269,430 | A * | 12/1993 | Schlaupitz et al. | 220/834 |
| 5,667,094 | A * | 9/1997 | Rapchak et al. | 220/839 |
| 5,788,064 | A * | 8/1998 | Sacherer et al. | 206/204 |
| 5,875,891 | A * | 3/1999 | Snell | 206/315.9 |
| 6,398,067 | B1 * | 6/2002 | Belfance et al. | 220/839 |

* cited by examiner

*Primary Examiner*—Luan K. Bui

(74) *Attorney, Agent, or Firm*—Greenberg Traurig, LLC

(57) ABSTRACT

The present invention relates to a moisture proof resealable non-cylindrical container and cap assembly for consumer packaging including candy, tobacco products, pharmaceutical products, electronic products, such as nard drives or circuit boards and coffee samples. The moisture proof resealable non-cylindrical container may be made of plastics, such as polypropylene and polyethylene. In addition, the non-cylindrical container has a cap, which includes a thumb tab to facilitate the opening and closing of the container.

2 Claims, 9 Drawing Sheets

SHELF LIFE CALCULATIONS BASED UPON MOISTURE INGRESS FOR A PART WEIGHT OF 4.5 GRAMS AND 60% MOLECULAR SIEVE

| INGRESS (MICROGRAMS/DAY) | TOTAL DAYS CAPACITY |
|---|---|
| 500 | 1242 |
| 750 | 828 |
| 1000 | 621 |
| 1250 | 497 |
| 1500 | 414 |
| 1750 | 355 |
| 2000 | 311 |

SECTION A-A

MOISTURE-PROOF RESEALABLE, NON-CYLINDRICAL CONTAINER FOR CONSUMER PACKAGES

CROSS REFERENCE TO RELATED APPLICATIONS

This application is related to U.S. Ser. No. 60/391,528, filed Jun. 25, 2002, entitled "A Moisture-Proof Resealable, non-Cylindrical Container for Consumer Packages"; is also related to U.S. Ser. No. 09/876,381, filed Jun. 1, 2001, now U.S. Pat. No. 6,705,463, issued Mar. 4, 2004, entitled "Flip Top golf Ball Container Assembly Provided with Moisture Barrier Properties" and is also related to U.S. Ser. No. 09/386,702, filed Aug. 31, 1999, now U.S. Pat. No. 6,769,558, issued Aug. 3, 2004, entitled "A Leak-Proof Container and Cap Assembly.

FIELD OF THE INVENTION

The present invention relates to a moisture-proof plastic resealable, non-cylindrical container for consumer packaging including candy, tobacco products (e.g. cigarettes) and pharmaceutical products (e.g. pills):

BACKGROUND OF THE INVENTION

Cylindrical containers are described in the following patents as being "leak-proof." For example, cylindrical leak-proof containers are disclosed in U.S. Pat. Nos. 4,783,056, 4,812,116, RE 37,676 and U.S. Pat. No. 6,303,064. The disclosure of the processes of producing injection molded plastic containers and sealing them are incorporated by reference herein.

Co-pending U.S. application Ser. No. 09/386,702, filed Aug. 31, 1999, now U.S. Pat. No. 6,769,558, issued Aug. 3, 2004, and assigned to the same assignee as the present application, discloses a leakproof, resealable cylindrical container and cap assembly, which comprises a cap and container attached by a hinge. The cylindrical container has an upper portion and an outer surface, and at the upper portion, the container has a rim. The cap has a circular base portion with an outer periphery and a cylindrical tubular skirt extending perpendicularly and outwardly around said outer periphery of the base; the skirt has an inner wall, which includes at least one recess. The cylindrical cap and container assembly, when in the closed position, form a leak-proof, air tight seal. The cap and container may be integrally molded of plastic, forming a hinge there between.

DETAILED DESCRIPTION OF THE PRESENT INVENTION

The present invention relates to a moisture proof, resealable non-cylindrical container and lid assembly. The term "resealable" means that the closure can be closed at least once after the container is opened for the first time. Preferably, the closure can be opened and closed additional times after the initial opening.

In another embodiment, the non-cylindrical cap and container assembly, in a closed position, forms a moisture proof seal. The term "moisture proof" refers to a rate of ingress of moisture into a scaled container of about 500 pg/day or less determined by the test method of the example.

Figure 1:
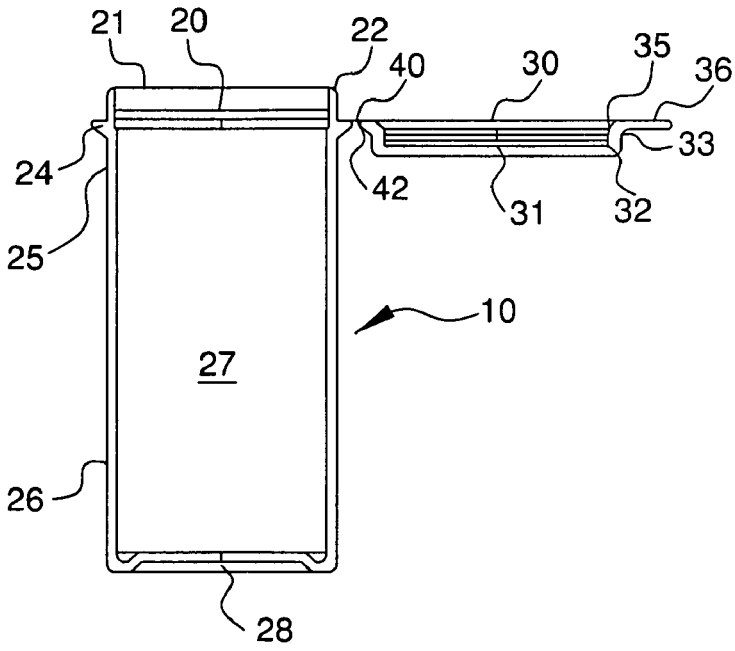
FIG. 1 is a side view of one embodiment of the present invention.
Figure 2:
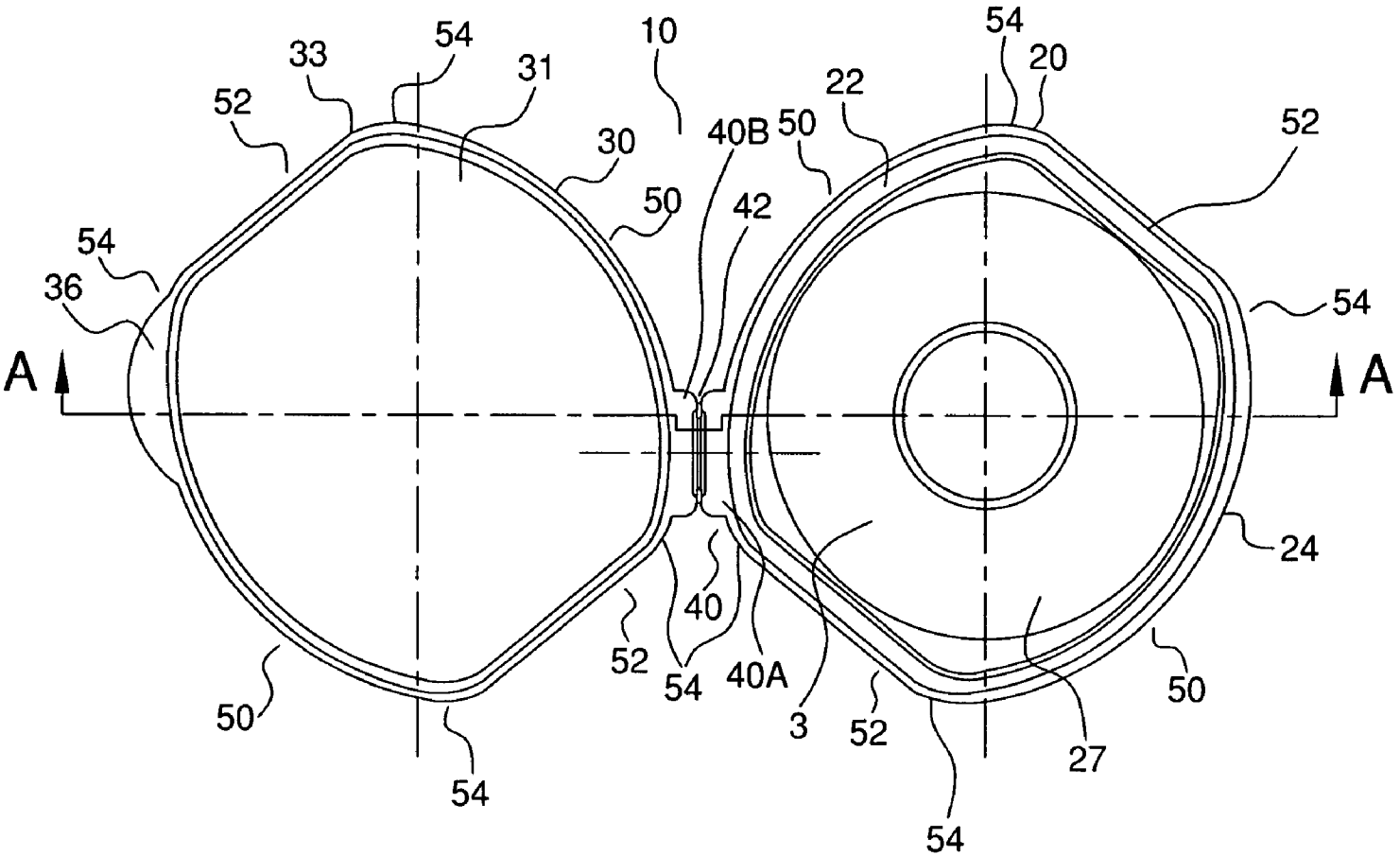
FIG. 2 is a top plan view of the embodiment of FIG. 1.

Referring now to FIGS. 1 and 2, where one embodiment of the resealable cap and container assembly 10 of the present invention is illustrated, the assembly 10 includes a container 20 having a base 28, an internal cavity 27, an outer surface 25, an upper portion 21 and lower portion 26. The container 20 has a rim 22 at the upper portion 21. The assembly 10 also has a cap 30 which has a base 31 and a skirt 33 extending perpendicularly around the outer periphery of the base 31. Optionally, the cap 30 is provided with a thumb tab 36 for facilitating the opening and closing of the container, and is attached to the container 20 by hinge 40. The tab 36 and hinge 40 are preferably positioned on opposing ends of the cap and extend perpendicularly from the skirt 33 of the cap 30.

The container may also have a flange 24 projecting radially outwardly from the outer surface 25 of the container 20. One or more hinges 40 arc attached to the container flange 24 or, to another part of the container. The hinge 40 also has a recess 42 that functions as a bending point during the opening and closing of the container. The hinge 40 has two elements, 40A and 40B, respectively, formed on either side of the recess. One element 40A is attached to the flange 24 of the container 20 and the second element 40B is attached to the cap 30.

As illustrated in FIG. 2, the cap and container are non-circular in shape. The cap and container each have curved sides 50 and flat sides 52, joined by rounded corners 54. Any kind of non-circular shape can be used in this invention, without regard to whether the shape is symmetrical or asymmetrical. Suitable shapes include the square, triangle, ellipse, rectangle, trapezoid, and numerous others. In one example, the container may be sized as rectangular with a substantially flat-top. If the assembly is provided with corners, as is the case with the embodiment of FIGS. 1 and 2, they may be squared or rounded.

The container is sized to hold one or more items. in one embodiment, the container is used to hold candy such gum, mints or chocolate. In another embodiment, the container is used to hold a pharmaceutical product such as pills or glucose test strips. In a further embodiment, the container is used to hold tobacco products such as cigarettes. In one specific example, the container is similarly sized as the present cigarette packages. In yet another embodiment, the container is sized to hold electronic products such as hard drives or circuit boards. In another embodiment, the container is used to hold coffee samples such as regular or instant coffee.

Suitable material for assembly 10 includes plastic (e,g, thermoplastics such as polypropylene and polyethylene). In one embodiment, the cap 30 and container 20 may be integrally molded of the plastic to form one or more hinges 40 therebetween. In one embodiment, the cap 30 and container 20 may be produced in a molding process and, in another embodiment, may be molded in accordance with the mold similar to that disclosed in U.S. Pat. Nos. 4,783,056 and 4,812,116, respectively or, in another embodiment, may be produced in accordance with U.S. Pat. No. 5,723,085 or 6,303,064. The disclosure of these patents are incorporated by reference herein.

Figure 5:
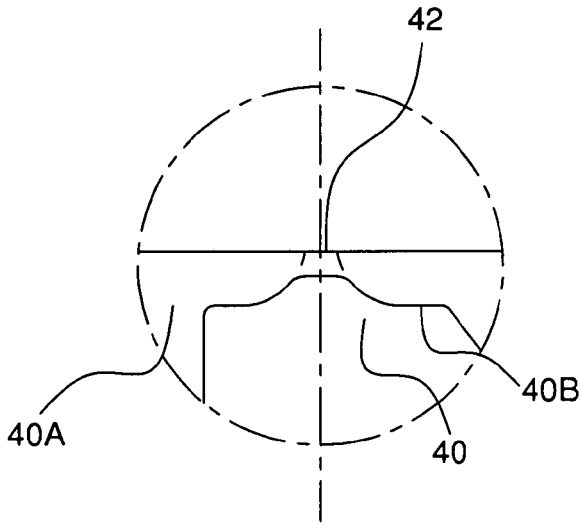
FIG. 5 is a perspective view of an embodiment of the hinge, which connects the cap and container.

Turning to FIG. 5, which shows the hinge 40 of one embodiment of the present invention, the recess 42 is characterized by a relatively thinner section of plastic material which bridges thicker sections 40A, 40B of the hinge 40. 'She recess 42 is a location which bends relatively easily and acts as the location where the hinge folds when the lid is closed, and as the location where the hinge opens when the lid is opened.

In another embodiment, the thumb tab 36 has a length from about 0.125 inches to about 0.325 inches, preferably 0.235 inches, measured from the outside perimeter of the cap to the end of the tab.

Figure 4:
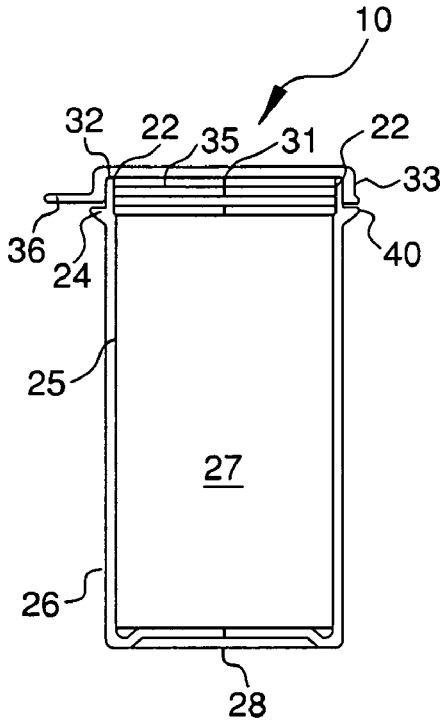
FIG. 4 is a cross-sectional side view of an embodiment of the assembly in a closed position.

FIG. 4 illustrates a cross-sectional view of the assembly 10 in a closed position. The skirt 33 of the cap 30 overlies the container 20 and lies upon the flange 24 of the container 30 while the rim 22 of the container 20 is situated within the recess 32 of the inner wall 35 of the skirt 33 of the cap 30.

Figure 6A:
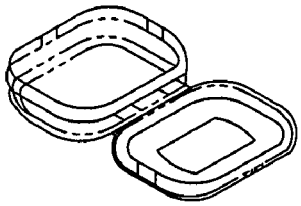
FIGS. 6A through 6H are another embodiment of the present invention showing perspective, side, top and cross-sectional views.
Figure 6B:
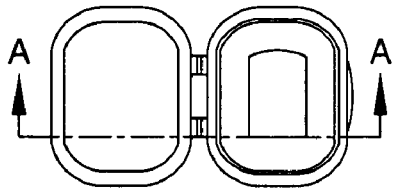
Figure 6C:
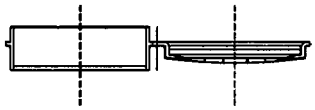
Figure 6D:
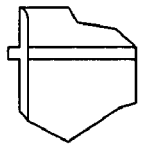
Figure 6E:
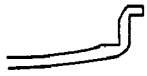
Figure 6F:
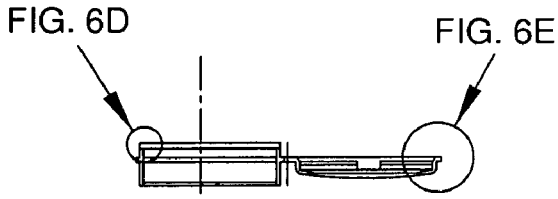
Figure 6G:
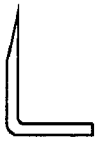
Figure 6H:
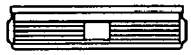

FIGS. 6A through 6H illustrates another embodiment of the present invention. FIGS. 6A through 6H illustrates a "flat-top" container. FIGS. 6D and 6E illustrate one embodiment of the "flat-top" container with the ridge, the gap and the skirt combine to form an annular region for interlocking with the rim on the container. The rim is adapted to sealingly fit within the gap formed between the seal and the outer cap rim. The top surface forms a smooth transition surface to further guide the seal around the container wall. In another embodiment, the seal can be proportionally larger than shown in FIG. 6E. For example, seal 74 can be proportionally about twice the height as shown in FIG. 6E. In another example, seal 74 can be proportional to the height shown in FIG. 7.

Figure 7:
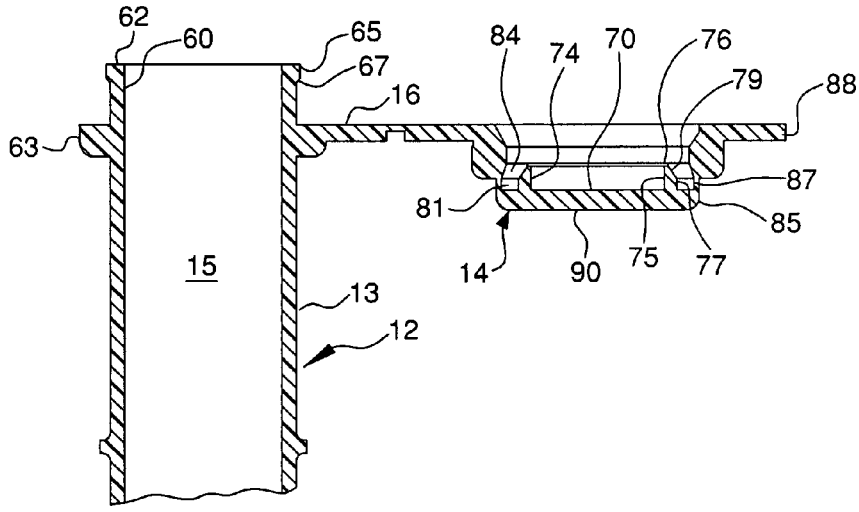
FIG. 7 is a side elevational view of another embodiment of the present invention.

FIG. 7 illustrates another embodiment of the present invention. Container 12 is provided with wall 13, which defines an internal cavity 15. The upper region of the container wall 13 is provided with a rim 63 extending around the periphery of the container 12. Rim 63 and the smooth transition surface at upper edge 62 of the container 12 form an annular region for interlocking with the cap 14. In one embodiment, the outer diameter at the rim 63 is greater than the outer wall diameter of wall 13. In one embodiment, it is about 0.025" greater. The outer diameter of the rim 63 is constant for about 0.033" at a first rim surface 65. Adjacent the first rim surface 65, a second rim surface 67 tapers down to the outer wall 13 of the container 12 over a distance of about 0.030" at an oblique angle, suitably about 21°.

The container 12 may be integrally connected to the cap 14 by means of a tab or flange 16. Cap 14 has a base 85, and a skirt 87 extending therefrom. Extending perpendicular to the skirt 87 is a thumb tab 88 for facilitating the opening and closing of the container. Ridge 74 is positioned on the interior 70 of the base 85, and extends perpendicularly therefrom. The outer wall 77 of the ridge 74 and the wall surfaces 87 of the cap rim define a gap 81 into which rim 63 is fitted to form a moisture-proof seal when the cap is in the closed position. An end surface 79 of the ridge 74 interconnects the inner edge 75 with the outer edge 77.

The ridge 74, the gap 81 and the skirt 87 combine to form an annular region for interlocking with the rim 63 on the container 12. The rim 63 is adapted to sealingly fit within the gap XI formed between the seal 74 and the outer cap rim. The top surface 76 forms a smooth transition surface to further guide the seal 74 around the container wall. In another embodiment, seal 74 can be proportionally smaller than shown in FIG. 7. For example, seal 74 can be proportionally about half the height as shown in FIG. 7. The another example, seal 74 can be proportional to the height shown in FIG. 6E.

Figure 7B:
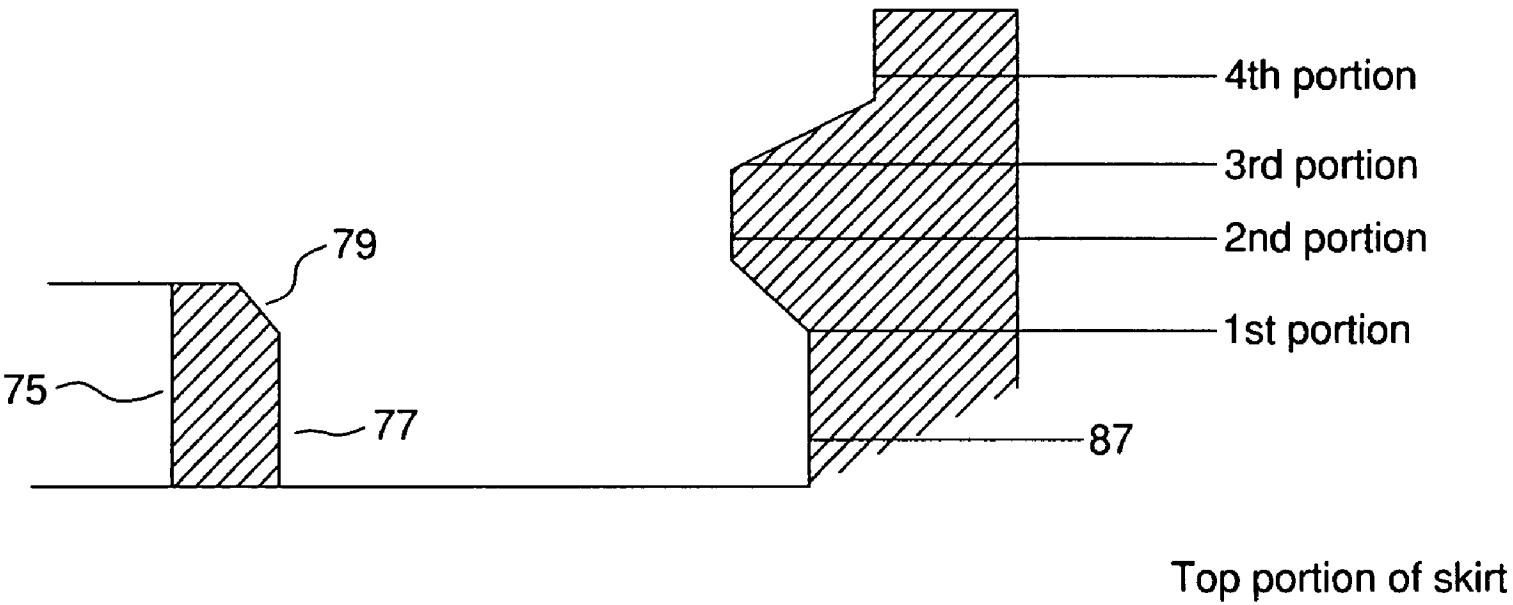
FIG. 7B shows a cross-sectional view of another embodiment of the present invention.

FIG. 7B shows a cross-section view of one embodiment of the cap and container assembly of the present invention. The inner wall of the skirt 87 of the cap 14 has a recess which extends downward from the top portion (93) of the skirt. The rim also has a second portion (92), connected to the top portion of the skirt, which is perpendicular to the base. The third portion (91) extends downward from the second portion and the fourth portion (90) extends downward from the third portion of the inner wall of the skirt.

In one embodiment, to insure that the moisture which may enters the container assembly is absorbed so it does not adversely affect the item within the container, a disc (e.g. puck), sleeve, or other shapes, either conforms to a part of the container or is placed within the container. U.S. Pat. No. 5,911,937 discloses a process and resulting structure for producing a desiccant insert. The method of making the desiccant insert is incorporated by reference herein as an embodiment of one method of making the desiccant insert. In addition, U.S. Pat. Nos. 5,911,937, 5,911,937, 6,214,255, 6,130,263, 6,080,350 and 6,174,952, 6,124,006, 6,221,446 and U.S. Ser. No. 09/504,029, filed Feb. 14, 2000, discloses various structures and positions in the container for the desiccant insert including a plug and a liner in the container. In one embodiment, the outer surface of the upper housing may be made of a sufficiently water impermeable plastic (e.g. PP or PE) and at least a portion of the inner surface may be molded with a desiccant plastic, such as the desiccant plastic formulations disclosed all of which are incorporated herein by reference. These structures and positions are also incorporated by reference herein as embodiments of various structures and positions of the desiccant insert.

In another embodiment, a suitable puck is constructed as follows: (a) 35% Polypropylene (Aristech manufacturer); (b) 5% Polyethylene Glycol (Dow manufacturer "E4500"); and (c) 60% Molecular Sieve (Elf AtoChem manufacturer "MS4A"). The above percentages are on a weight/weight basis. The components are blended and extruded into pellets. The pellets are injection molded into the desiccant puck. All sample components are in the solid phase. The total weight of the molded puck can be approximately 4.5 grams. In another embodiment, a desiccant may be blended with a thermoplastic material to form a suitable shape.

In a further embodiment in the area of tobacco products, the rigid flip-top container can be composed of an outer surface of the container of a sufficiently water impermeable plastic (e.g. PP or PE) and at least a portion of the inner surface may be molded with one or more of the following: a) an aroma releasing film (e.g. menthol, mint and/or other desirable aroma or fragrant components); b) an absorbing component to preserve the tobacco; and/or c) a releasing component. U.S. Pat. Nos. 5,911,937, 5,911,937, 6,214,255, 6,130,263, 6,080,350 and 6,174,952, 6,124,006, 6,221,446 and U.S. Ser. No. 09/504,029, filed Feb. 14, 2000, discloses various structures and positions in the container for the liner in the container. The method of making the liner is incorporated by reference herein as an embodiment of one method of making the liner.

EXAMPLE

The moisture ingress through the flip-top seal of the container of the present invention is determined over a fifty (50) day period. A total of six (6) containers are used for the study. Two containers, referred to as CONTROL A and Control B, do not contain desiccant. Four other containers, referred to as Samples C, D, E, F, have 2.0 grams of loose molecular sieve (MS) powder placed inside, plus or minus 0.25 grams. The dimensions of the containers are approximately 1.8" in diameter×5.3" tall. The test method can be described as follows: (a) placing two grams plus or minus 0.25 grams of molecular sieve ("MS") into four (4) containers 1.8" in diameter×5.3" tall and recording the weight; (b) recording the weight of two of the same containers which do not contain any MS material, which containers are maintained as controls; (c) closing the containers by applying, in a singular motion, a downward pressure upon the container lids or thumb tabs until the rim portions, adjacent to the thumb tabs, contact the inside that part of the caps also adjacent to the thumb tabs; (d) weighing the six (6) containers and recording their respective weights; (e) placing the closed containers in an environmental chamber maintained at conditions of 80% relative humidity and 72° F. (f) weighing the containers on a daily basis for fifty (50) days, recording the weights of the respective containers, and returning them to the chamber; (g) subtracting the weights recorded in steps (a) and (b) from the current day weight of the respective containers to calculate the moisture ingress of the container in units of micrograms of water; and (h) determining the moisture ingress through the seal by discounting the moisture ingress through the vial, according to the following methodology, calculated on a daily basis:

| | |
|---|---|
| n- | Sample Type (A–F) |
| Sn- | Sample Weight Gain = (Current Vial Weight − Initial Vial Weight at Start of Study) |
| Ctrl- | Average Weight Gain of Control Samples = (SA + SB)/2 |
| TS- | Average Weight Gain of Test Samples = (SC + SD + SE + SF)/4 |
| MI- | Moisture Ingress through Seal = (TS − Ctrl). |

A relative humidity transducer is mounted in the environmental chamber. The transducer measures the relative humidity inside the chamber. The transducer is a capacitive type, composed of a thin polymer lilm, with a 0–100% relative humidity operating range, accuracy +−3% RH from 10–90% at (−20–40° C.), resolution: >0.04% between (25.60% KH).

Results

Figure 8:
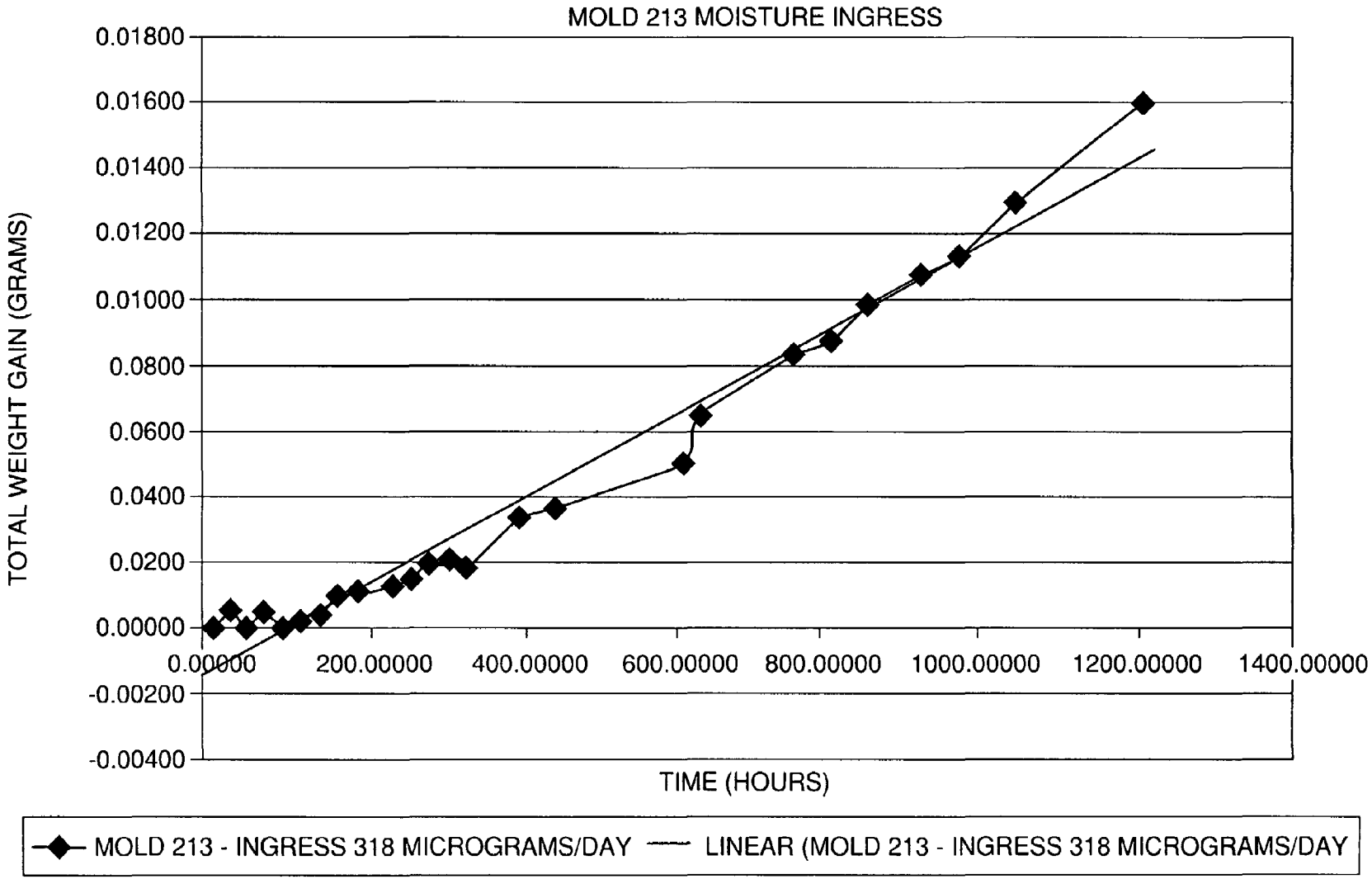
FIG. 8 is a plot of moisture ingress through the seal over a 50 day period (measured in hours)

The data collected shows that the average moisture ingress through the flip-top seal is 318 μg per day over the test period. The rate of moisture ingress is relatively constant over the test period, as shown by the plot in FIG. 8. l'he data is presented in 'Sable I. The MS absorbs approximately 5% of its total capacity.

Figure 3:
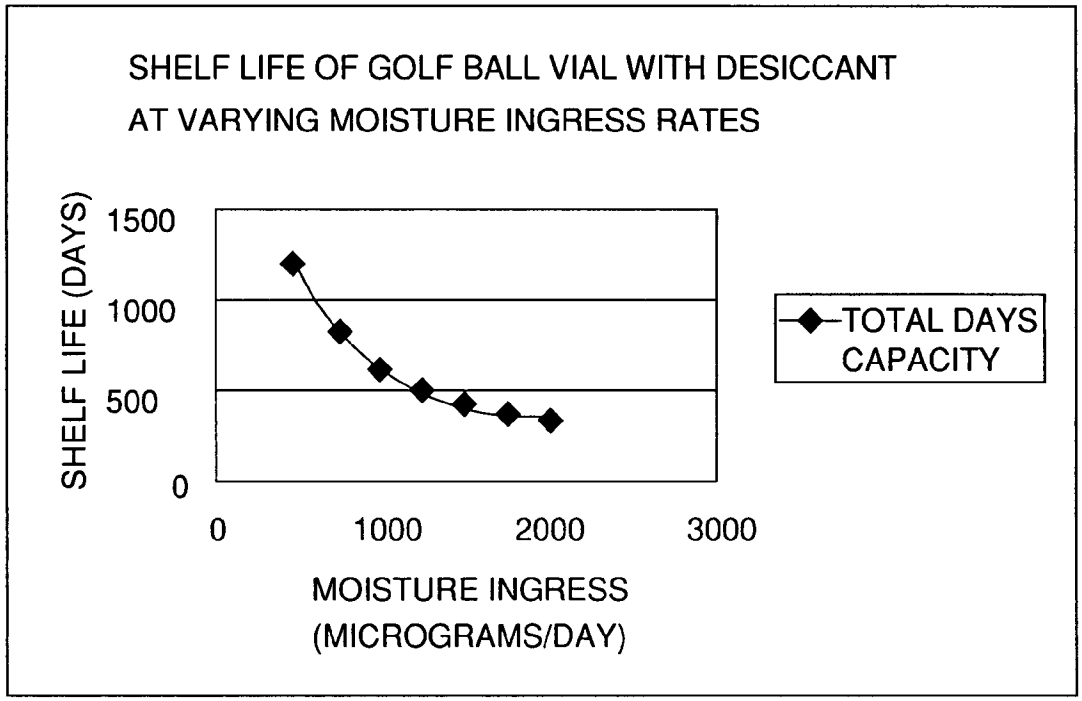
FIG. 3 is a plot of shelf life of golf balls stored in container with desiccant.

FIG. 3 shows the relationship between shelf life and moisture ingress rate of a 4.5 gram desiccant puck containing 60% (w/w) desiccant material.

What is claimed is:

1. A moisture-proof resealable non-cylindrical container and cap assembly, comprised of:

a non-cylindrical container and a correspondingly shaped non-cylindrical cap integrally attached to the container;

wherein the container having an upper portion and an inner and outer surface, the container having an upstanding rim at the upper portion, the rim is defined as that portion of the container that contacts an inner wall of the cap, the rim having an inner and outer wall rim, whereby the inner rim wall is substantially parallel to the inner surface of the container;

a cap having a base with an outer periphery and a skirt extending perpendicularly and outwardly around the outer periphery of the base, the skirt having an inner wall, the inner wall of the skirt comprising at least four portions, a first portion that is a conically tapered, extends downward from a top portion of the skirt and is substantially planar, a second portion connected to the first portion and that is substantially perpendicular to the base, extends downward from the first portion, and is substantially planar, a third portion connected to the second portion and extends downward from the second portion, a fourth portion connected to the third portion and extends downward from the third portion, the inner wall having at least one cap recess formed by at least the third and fourth portions of the inner wall of the skirt, the cap having opposing ends, the cap including a thumb tab for facilitating the opening and closing of the container, the cap comprising at least one hinge attached to the container wherein the hinge has at least one hinge recess bend point that functions to rotate the cap at one pivot point, the thumb tab and the hinge being positioned on substantially opposing ends of the cap and extending perpendicularly and outwardly from the skirt of the cap;

wherein the skirt of the cap overlies the container and at least a portion of the rim of the container engages the cap recess of the inner wall of the skirt of the cap so that a substantially moisture-proof seal is obtained when a frontal, downward pressure is applied and the container is fully closed, and wherein the moisture-proof seal allows less than about 500 micrograms of water ingress per day into the container; and wherein the moisture-proof seal is obtained without the presence of an interlocking mechanism, whereby the interlocking mechanism consists of a projection, a gap and the annular skirt of the cap that combine to form a an annular channel for interlocking with the rim of the container, the annular channel is an annular gap formed between the annular projection and the inner wall of the skirt of the cap whereby the annular projection projects from an interior surface of the cap and is substantially perpendicular to the interior surface of the cap.

2. A moisture-proof resealable non-cylindrical container and cap assembly, comprised of:

a non-cylindrical container and a correspondingly shaped non-cylindrical cap integrally attached to the container;

wherein the container having an upper portion and an inner and outer surface, the container having an upstanding rim at the upper portion, the rim is defined as that portion of the container that contacts an inner wall of the cap, the rim having an inner and outer wall rim, whereby the inner rim wall is substantially parallel to the inner surface of the container;

a cap having a base with an outer periphery and a skirt extending perpendicularly and outwardly around the outer periphery of the base, the skirt having an inner wall, the inner wall of the skirt comprising at least four portions, a first portion that is a conically tapered, extends downward from a top portion of the skirt and is substantially planar, a second portion connected to the first portion and that is substantially perpendicular to the base, extends downward from the first portion, and is substantially planar, a third portion connected to the second portion and extends downward from the second portion, a fourth portion connected to the third portion and extends downward from the third portion, the inner wall having at least one cap recess formed by at least the third and fourth portions of the inner wall of the skirt, the cap having opposing ends, the cap including a thumb tab for facilitating the opening and closing of the container, the cap comprising at least one hinge attached to the container wherein the hinge has at least one hinge recess bend point that functions to rotate the cap at one pivot point, the thumb tab and the hinge being positioned on substantially opposing ends of the cap and extending perpendicularly and outwardly from the skirt of the cap; and wherein the skirt of the cap overlies the container and at least a portion of the rim of the container engages the cap recess of the inner wall of the skirt of the cap so that a substantially moisture-proof seal is obtained when the container is fully closed, and wherein the moisture-proof seal allows less than about 500 micrograms of water ingress per day into the container.

* * * * *